United States Patent [19]

Schler

[11] 4,401,183

[45] Aug. 30, 1983

[54] HIGH RISE LIFE ESCAPE LADDERS

[76] Inventor: Eli Schler, 1325-13th Ter., Miami Beach, Fla. 33139

[21] Appl. No.: 364,790

[22] Filed: Apr. 2, 1982

[51] Int. Cl.[3] ..... E06C 9/10; E06C 9/14; E06C 1/383; E06C 1/52

[52] U.S. Cl. ..... 182/8; 182/85; 182/95; 182/163

[58] Field of Search ..... 182/8, 97, 163, 164, 182/206, 129, 88, 93, 115, 70, 85, 95

[56] References Cited

U.S. PATENT DOCUMENTS

| | | | |
|---|---|---|---|
| 1,460,479 | 7/1923 | Dixon | 182/85 |
| 1,603,638 | 10/1926 | Phillips | 182/163 |
| 2,616,608 | 11/1952 | Bellamy | 182/70 |
| 3,012,626 | 12/1961 | Marryatt | 182/70 |
| 3,117,651 | 1/1964 | Singer | 182/85 |
| 3,144,093 | 8/1964 | Proctor | 182/70 |
| 3,385,399 | 5/1968 | Burt | 182/70 |
| 4,085,818 | 4/1978 | Swager | 182/8 |
| 4,211,306 | 7/1980 | Brenner | 182/163 |

*Primary Examiner*—Reinaldo P. Machado
*Attorney, Agent, or Firm*—Jesus Sanchelima

[57] ABSTRACT

A fire escape ladder system for high-rise buildings having balconies with parapets. Each balcony stores its own corresponding ladders. A first ladder is securely mounted on the parapet. This ladder folds out and over the parapet when in use. A second ladder with a flanged top is pushed through a cooperating opening at the base of the parapet. The flange prevents the ladder from sliding through the opening. This second ladder descends to the top of the next lower balcony where it is secured with a bar and clamp assembly. Each user wears a safety belt that connects to T-shaped longitudinal slots integrally formed in both side pieces of the ladder. The ladder systems provide escape routes from balcony to balcony to ground.

5 Claims, 7 Drawing Figures

HIGH RISE LIFE ESCAPE LADDERS

BACKGROUND OF THE INVENTION

1. Field of the Invention

The present invention relates to external fire escape ladders for high-rise buildings and particularly to a series of ladders between the balconies of each floor, such that the occupants of the burning building can escape simultaneously descending from balcony to balcony, and then to ground level.

2. Description of Prior Art

It is well known that a method of escape from a burning building can be accomplished by means of a system of ladders attached to the exterior walls of a building. In the latter part of this century, with advanced methods of construction, buildings are being built higher and higher. In addition, the trend has been to make interior fireescape stairwells. However, if the fire is from within the building, these inner stairwells become filled with smoke or are not locatable by the building's occupants.

Exterior ladders have been unsightly, and they allow entry to the building from the outside and ground levels. Also, the users of external fire escape ladders are in constant peril of falling because of the difficulty of using the ladders.

One improvement to the fire-escape ladders, documented by the U.S. Pat. No. 3,117,651 to B. L. Singer, et al., on Jan. 14, 1964, and U.S. Pat. No. 1,460,479 to A. S. Dixon on July 3, 1923, is the collapsable ladder which limits access to the upper floors. These ladders when collapsed create a more aesthetic appearance and allow unobstructed views from the balcony. Mr. Dixon's patent claims a rigid ladder to reach the top of the balcony. However, his patent is limited to second floor landings and there is considerable difficulty and peril in moving one's person from the rigid ladder to the folding ladder 1, while "clinging" to the same folding ladder and crossing over the rail at the same time.

In Mr. Singer's invention, access to the collapsable ladder is by means of an opening gate in the balcony rail, which in non-emergency periods could be dangerous.

Safety belts have been suggested as in U.S. Pat. No. 303,638 to A. H. Hall on Aug. 19, 1884. Mr. Hall's belts are used by the operator of the system FIG. 5, and a second belt in his FIG. 7 is used to lower persons to the ground using Rail C, neither of these belts cooperate with the ladder itself.

Other patents describing the closest subject matter provide for a number of more or less complicated features that fail to solve the problem in an efficient and economical way. None of these patents suggest the novel features of the present invention.

SUMMARY OF THE INVENTION

It is the main object of this invention to provide a reliable external fire escape system for multiple story buildings.

It is another object of this invention that the system be utilized by a number of people simultaneously from within an apartment, or the entire building, and with safety for each user.

It is yet another object of this invention to provide a system that can be stored out of view, creating an aesthetic appearance on the balcony, and yet be readily accessible and easy to use.

It is yet another object of this invention that the high rise Life Escape System be built and produced inexpensively.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DESCRIPTION OF THE PREFERRED EMBODIMENT

Figure 1:
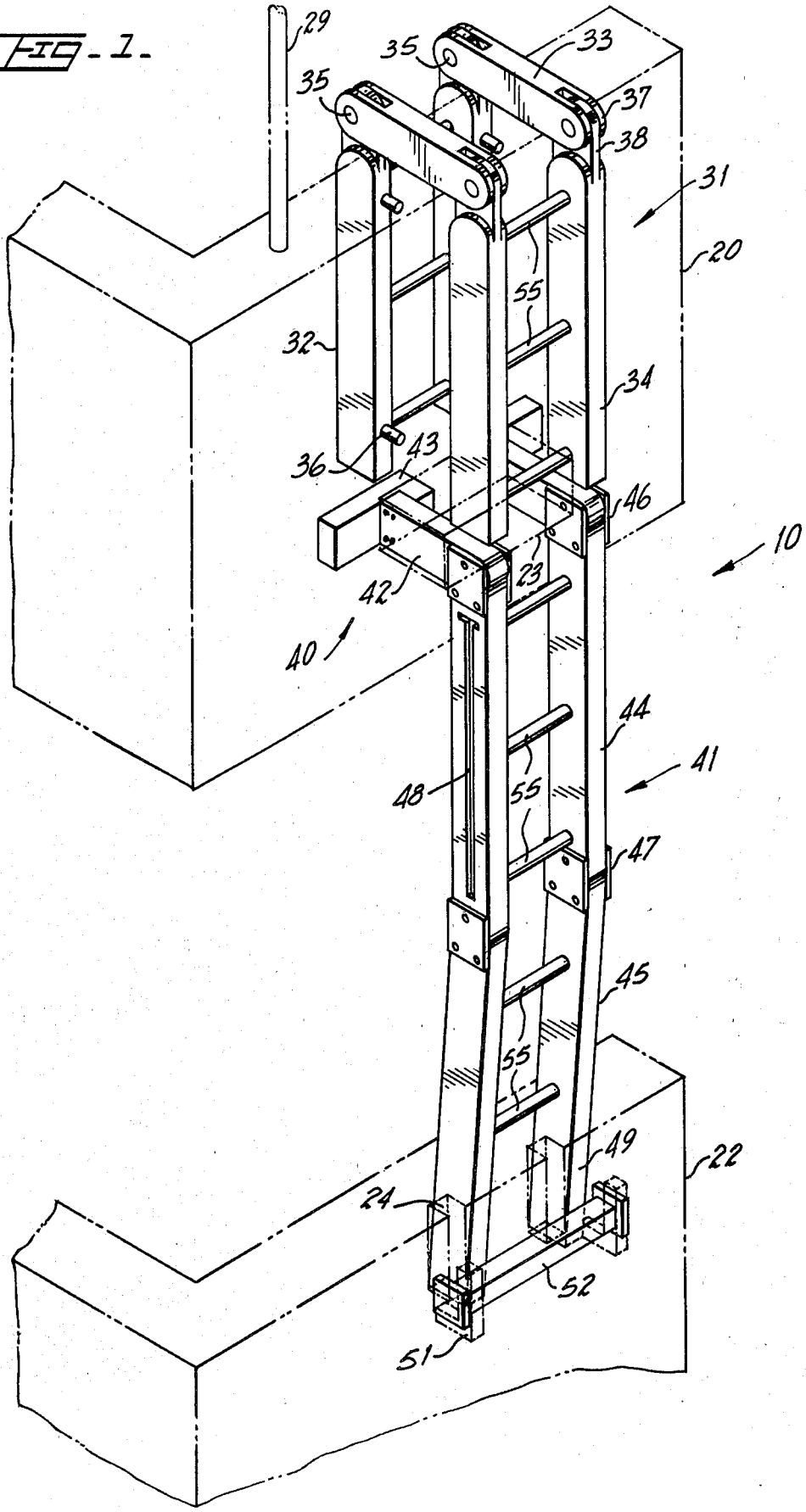
FIG. 1 illustrates in perspective the present invention in operation between an upper balcony and a lower balcony, of a high-rise building.

Referring now to FIG. 1 where the hi-rise life escape ladder is referred generally with numeral 10. The ladder is shown between two solid walled terraces, upper terrace 20 and lower terrace 22, which are common in high-rise buildings. In a typical high-rise building, there would be a vertical line of terraces, the hi-rise life escape ladder provides a means for escape from terrace to terrace to the ground. Each terrace has a ladder, which is stored until needed. The storage system will be shown later.

It can be observed that the system is made of two ladder assemblies with rungs 55, namely, an over the top ladder assembly 31 and a lower ladder assembly 41. The over the top ladder assembly 31 has an inner ladder 32 which is permanently attached to the inside of the parapet by bolts 36 which are secured to the parapet, and an outer ladder 34. Ladders 32 and 34 are connected by connector ladder 33, which has female ends 37 and is pivotally connected to the male ends 38 of ladders 32 and 34 by cotter pins 35. To facilitate climbing over the parapet and balancing oneself on the over the top ladder assembly 31, support pole 29 is provided.

Lower ladder assembly 41 has three sections: an upper section 40 including connecting member 42 with angle iron 43 permanently attached to connecting member 42, keeping it from sliding through opening 23; middle section 44; and lower section 45. The lower and middle sections are hinged at 46 and 47. These hinges allow a 90 degree angle between the sections. The lower end of the lower section 45 is held firmly to the lower terrace 22 by "U" clamps 51 and bar 52, which is placed between the U-clamp 51 and the termination 49 of lower section 45. Lower section 45 fits within recessed spaces 24 of terrace 22.

Figure 2:
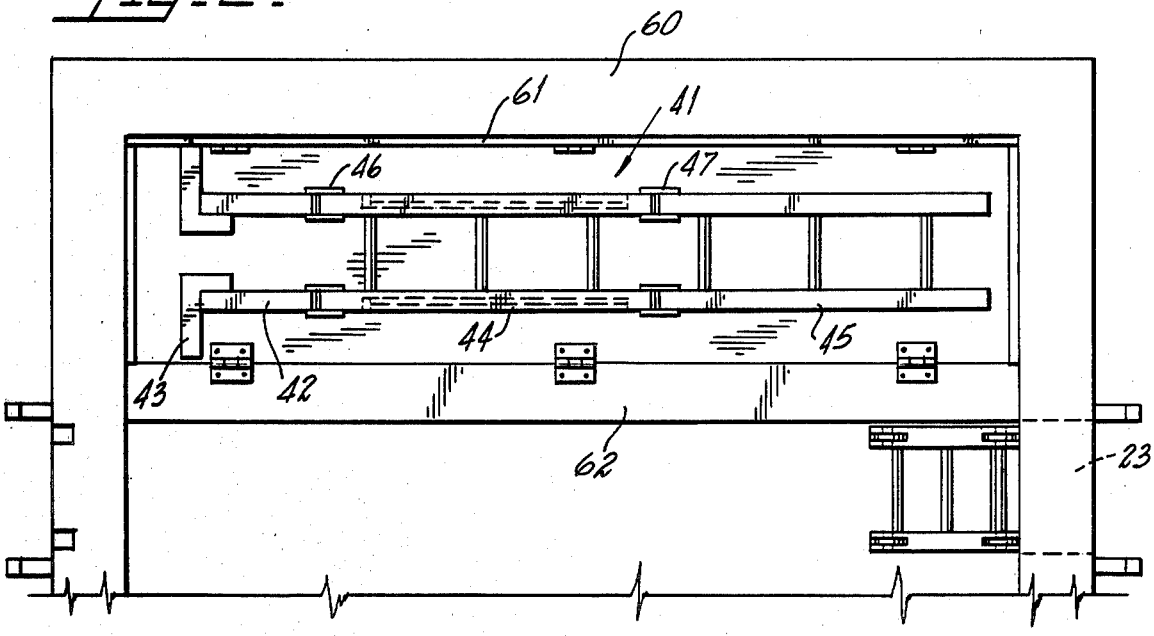
FIG. 2 shows a top view of the terrace showing the high-rise life escape system stored, when not in use.
Figure 3:
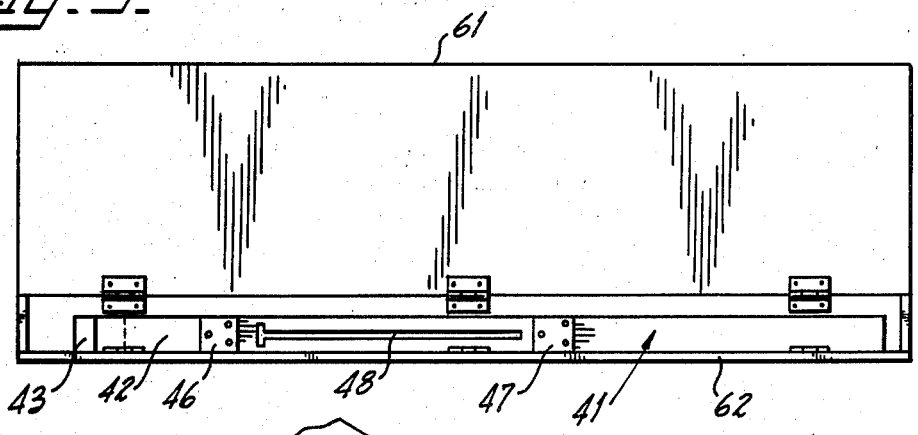
FIG. 3 shows the front view of the storage box for the lower ladder.
Figure 4:
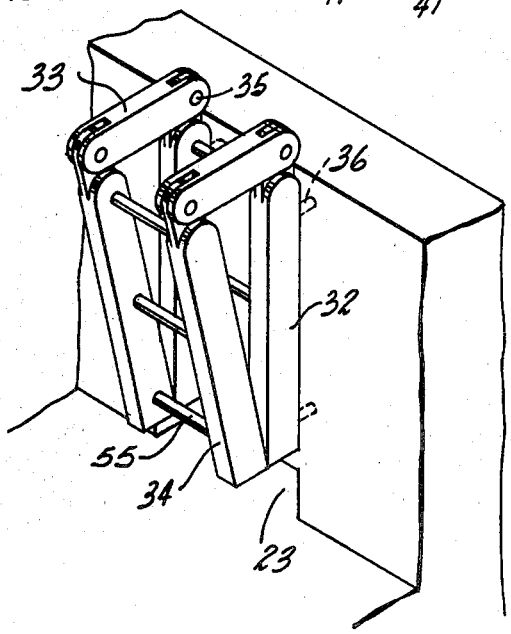
FIG. 4 shows, in perspective, the over the top ladder in storage position.

When the hi-rise life escape ladder is not in use, the over the top ladder 31 is folded back onto terrace 20, as shown in FIG. 4, and becomes a decorative part of the terrace. Lower ladder 41 is stored in a flat position in box 60. Box 60 runs the length of the front portion of the terrace floor and has a hinged top door 61, and hinged front door 62. Front door 62 folds down on the terrace floor in a flat position allowing lower ladder 41 to slide out of the box 60 without being lifted. When stored, the lower end of ladder 41 points toward opening 23 as shown in FIG. 2.

Figure 5:
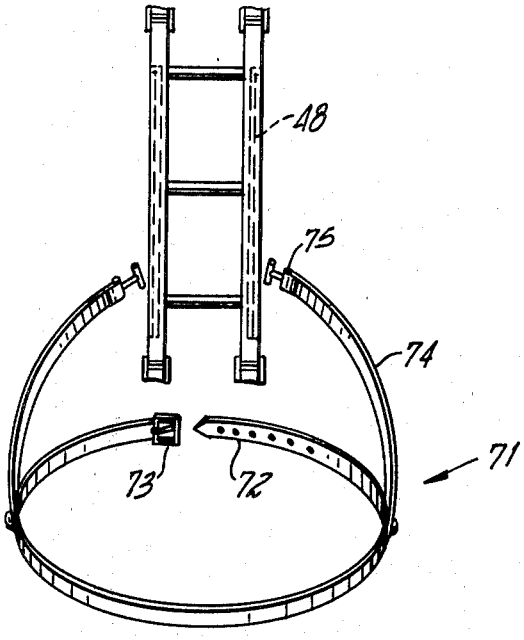
FIG. 5 shows the safety belt with the ladder in disproportionate smaller size.

Middle section 44 has lateral T-slotted runway 48 to receive the removable safety belt 71 as shown in FIG. 5. The size adjustable safety belt 71 has a belt section 72 with belt buckle 73, both of conventional design. Two belt members 74 are securely attached on one end to belt section 72, and the other end has securely attached 'T' piece 75. This 'T' piece 75 will removably insert and slide along 'T' slot 48 in the lower ladder 41.

Hi-rise life escape ladder 10 is used in connection with an upper terrace 20, and lower terrace 22. Each upper terrace has an opening 23 to accommodate lower ladder 41. When descending to the next lower terrace, lower terrace 22 becomes the upper terrace with a corresponding lower terrace. As upper terrace 20 has a storage box with ladder so then lower terrace 22 will have its corresponding storage box and ladders. The system will alternate ladders from one side of a terrace to the other. Thus, FIG. 2 being a typical terrace, the right side shows the top of the ladders, and the left side will receive the bottom of the ladders from the above terrace. The next lower terrace will receive the bottom of the ladders on its right side, and will have the top of the ladders on its left side. This will alternate until ground level is reached.

In operation, the over the top ladder 31 is folded over towards the exterior side of the parapet. The box 60, shown in FIG. 2, is opened and the ladder 41 is pushed out through opening 23. Hinges 46 and 47 reduce the length of the ladder that must fall at one time. Preferably, the neighbor on the lower terrace will secure the lower ladder with bar 52, though this can be done by the first person who climbs down the ladder. If after climbing down the ladder, the lower terrace ladder is not in place, it is a simple operation as just described to again set up the hi-rise life escape ladder. Thus, one descends from terrace to terrace. Once the system is in use, any number of persons can escape, each with their own safety belt, and it is possible for many persons to orderly escape simultaneously.

Figure 6:
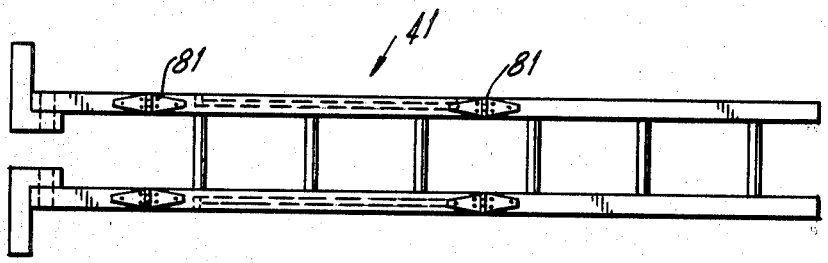
FIGS. 6 and 7 show the clasp hinges for making the ladders of wood.
Figure 7:
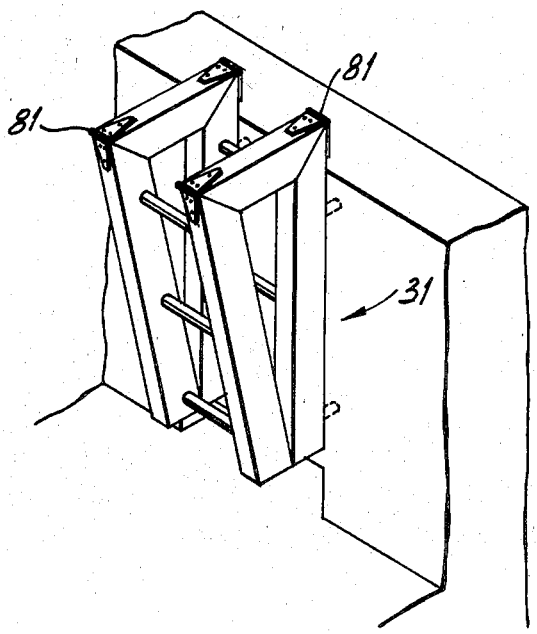

The hi-rise life escape ladder as shown in FIG. 1 can be made of aluminium or other metal. The hi-rise life escape ladder could also be made of wood with clasp hinges 81 as shown in FIG. 6. The over the top ladder 31 would have the same clasp hinges 81.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense, except as set forth in the following appended claims.

What is claimed is:

1. A fire escape ladder system for high rise buildings having balconies provided with parapets, comprising:

A. First ladder means mounted on sides of said parapets including a fixed inner ladder that allows the user to reach the top of the parapet and an outer ladder hingedly connected to the upper end of said inner ladder and extending downwardly;

B. second ladder means including an upper ladder section having a flanged termination, a middle ladder section hingedly connected to said upper section, and a lower ladder section hingedly connected to said middle ladder section, and second ladder means being removably mounted in said balconies through a cooperating opening in said parapet of sufficient size to allow said ladder sections to slide through and small enough to prevent said flange termination from sliding through.

2. The device set forth in claim 1 wherein said middle ladder section includes T-shaped longitudinal slots integrally formed in both side pieces of said ladder.

3. The device set forth in claim 2 wherein said second ladder means is removably secured to the next lower parapet by means of a bar and clamp assembly.

4. The device set forth in claim 3 wherein said second ladder assembly has a fixed storage box on said balcony.

5. The device set forth in claim 2 wherein a safety belt is removably connected to said T-shaped longitudinal slots to provide safety for users of said ladder system.

* * * * *